US007897887B2

(12) United States Patent
Blank

(10) Patent No.: US 7,897,887 B2
(45) Date of Patent: Mar. 1, 2011

(54) BALL SWITCH IN A MULTIBALL SWITCH ARRANGEMENT

(75) Inventor: Thomas Blank, Karlsruhe (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 83 days.

(21) Appl. No.: 12/518,594

(22) PCT Filed: Nov. 17, 2007

(86) PCT No.: PCT/EP2007/009966

§ 371 (c)(1),
(2), (4) Date: Jun. 10, 2009

(87) PCT Pub. No.: WO2008/071289

PCT Pub. Date: Jun. 19, 2008

(65) Prior Publication Data

US 2010/0059345 A1 Mar. 11, 2010

(30) Foreign Application Priority Data

Dec. 12, 2006 (DE) ..... 10 2006 058 473

(51) Int. Cl.
*H01H 35/02* (2006.01)

(52) U.S. Cl. ..... 200/61.45 R

(58) Field of Classification Search ..... 200/61.45 R, 200/61.52, 231.1, 84 R, 220, 193, 229, 52 R, 200/215

See application file for complete search history.

(56) References Cited

U.S. PATENT DOCUMENTS

| | | | | |
|---|---|---|---|---|
| 4,884,067 | A * | 11/1989 | Nordholm et al. | 340/689 |
| 5,136,127 | A * | 8/1992 | Blair | 200/61.52 |
| 5,202,559 | A | 4/1993 | Durst et al. | |
| 5,410,113 | A | 4/1995 | Mielke | |
| 5,627,316 | A * | 5/1997 | De Winter et al. | 73/514.32 |
| 5,987,988 | A | 11/1999 | Kunimi et al. | |
| 6,339,199 | B1 * | 1/2002 | Chou et al. | 200/61.52 |
| 7,649,150 | B2 * | 1/2010 | Masuda | 200/61.45 R |

FOREIGN PATENT DOCUMENTS

| | | |
|---|---|---|
| DE | 671328 | 2/1939 |
| DE | 3921926 | 12/1990 |
| DE | 9106217 | 9/1991 |
| DE | 10158416 | 7/2003 |
| DE | 10353438 | 6/2005 |
| EP | 1316981 | 6/2003 |
| EP | 1335183 | 8/2003 |

* cited by examiner

*Primary Examiner* — Edwin A. Leon

(74) *Attorney, Agent, or Firm* — Leydig, Voit & Mayer, Ltd.

(57) ABSTRACT

A ball switch for a multi ball-switch arrangement includes a base plate and a metallic circular disk centrally disposed on the base plate. A first electrically-conductive contact track, which is co-planar with the circular disk, extends from the circular disk to a first edge of the base plate. A chamber plate having a through-bore is disposed opposite the base plate so as to form a chamber which concentrically circumscribes the circular disk. The chamber has a metallic inner wall with a circumferential first metallic annular strip disposed at a first end thereof at a first side of the chamber plate. A dielectric sealing ring which concentrically surrounds the circular disk is disposed between the first metallic annular strip and the base plate so as to seal the chamber. An electrically conductive ball is disposed in the chamber and has a diameter which prevents a further similar conductive ball from fitting into the chamber.

12 Claims, 2 Drawing Sheets

BALL SWITCH IN A MULTIBALL SWITCH ARRANGEMENT

CROSS REFERENCE TO PRIOR APPLICATIONS

This application is a U.S. National Phase application under 35 U.S.C. §371 of International Application No. PCT/EP2007/009966, filed on Nov. 17, 2007, and claims benefit to German Patent Application No. DE 10 2006 058 473.2, filed on Dec. 12, 2006. The International Application was published in German on Jun. 19, 2008 as WO 2008/071289 under PCT Article 21(2).

FIELD

The present invention relates to the design of a ball switch in a multi ball-switch arrangement.

BACKGROUND

The German Patent DE 6 71 328 describes a centrifugal ball switch where the ball rolls unhindered under the influence of its own centrifugal force and produces the requisite contact pressure in that the movable parts holding the ball are checked by projections, for example, in response to the closing of the switch.

The German Patent DE 39 21 926 C1 describes an electrical switch for movable devices or device parts which switches automatically as a function of the position and/or movement. The switch is composed of a housing of insulating material in which outwardly projecting electrical contacts are nonadjustably fixed. Configured so as to be freely movable on the inside of the same is a contact member of electrically conductive material that cooperates with the fixed contacts for closing and opening operations. The movable contact member is a ball; the fixed contacts are metallic contact pins which are configured in parallel or substantially in parallel. Two contact pins can be electrically bridged at any one time by the ball when it is in the appropriate, corresponding position.

The German Patent Application DE 103 53 438 A1 describes a contact configuration for rotary and slide switches. A spring-loaded contact part assumes both the stopping, as well as the contact function. The contact part is a spring-mounted ball, for example, which engages in bores of a circuit board whose bore edges are provided with printed conductors that are divided into sections, the conductive balls interconnecting the sections.

A ball switch for signaling selectable inclination directions of a base plane is described in the German Utility Model G 91 06 217.9 U1. The final bearing positions of the switching balls are circular and are constituted of narrowing recesses in a side wall of the interior space disposed on the base wall. They are dimensioned in such a way that their axis of symmetry extends through and directly above the center of the switching ball which moves onto the corresponding corner of the base polygon, engaging thereon. Each recess is joined via a bore, which leads into the base of the recess, to a light-tight chamber which is assigned only to this recess and within which one of the light-transmitting elements or light-detector elements is configured.

U.S. Pat. No. 5,410,113 describes a motion sensor which is composed of two substrates, of contact means, and of at least one electrically conductive element. On its main side, the first substrate has an exposed, electrically conductive layer. The second substrate has a through-hole which extends from one main side to the other. The first and second substrate rest contiguously against one another on the main side in such a way that the contact surface on the first substrate appears within the front end of the through hole. The freely movable element held in the through-hole is able to electrically bridge the conductive layer on the first substrate via contact means on the inner wall of the bore.

U.S. Pat. No. 5,987,988 describes an acceleration sensor which is composed of a hollow cylinder chamber having a tubular contact surface on the interior. This hollow cylinder chamber has a bottom and a cover plate. In this configuration, an electrically conductive ball is enclosed, which, in response to a position of rest or uniform movement of the chamber, assumes a stable position by way of a central recess in the base area. In response to sufficient acceleration, the central recess and an adjacent annular surface, which are not contacted by the tubular contact surface, are bridged by the enclosed ball during sustained high acceleration because the ball is deflected out of its position of rest during such a phase.

The German Patent DE 101 58 416 C1 and the European Patent Application EP 1 316 981 A1 describe a multi ball-switch arrangement that is assembled from a plurality of plates in a layer- or stack-type of construction. The ball-switches are arranged in a serial configuration. Substantially identical circular disks of electrically conductive material are located on a first plate, the exterior plate. A contact tag extends radially outwardly from each of these circular disks to the edge of the ball switch formed therewith. Via this contact tag and by way of a galvanically through-plated bore, the circular disk is electrically connected to solder pads located on the bottom side of the circuit board. (In this regard, see the drawing including FIG. 1 through 10.) The circular disk is electrically connected to the contact track via an electroplated bore. The contact track is located in a different plane than the circular disk in order to provide the electrical isolation between the chamber and contact track.

This design is costly since the plate bearing the circular disk is made up of two plates. The two plates are laminated together following the wet chemical patterning of the contact track and of the circular disk and are electrically interconnected via a galvanically coated bore. This type of design is expensive in terms of process engineering.

SUMMARY

In an embodiment, the present invention provides a ball switch in a multi ball-switch arrangement including a base plate and a metallic circular disk centrally disposed on the base plate. A first electrically-conductive contact track, which is co-planar with the circular disk, extends from the circular disk to a first edge of the base plate. A chamber plate having a through-bore is disposed opposite the base plate so as to form a chamber which concentrically circumscribes the circular disk. The chamber has a metallic inner wall with a circumferential first metallic annular strip disposed at a first end thereof at a first side of the chamber plate and a second metallic annular strip disposed at a second end thereof at a second side of the chamber plate. A dielectric sealing ring which concentrically surrounds the circular disk is disposed between the first metallic annular strip and the base plate so as to seal the chamber. An adhesive layer is disposed between the chamber plate and the base plate around the circular disk so as to electrically insulate the inner wall from the circular disk. An electrically conductive ball is disposed in the chamber and has a diameter configured to prevent a further similar conductive ball from fitting into the chamber.

BRIEF DESCRIPTION OF THE DRAWINGS

An example of a miniaturized ball switch according to the present invention is presented in the following with reference to two figures. Other features and advantages of various embodiments of the ball switch according to the present invention will become apparent by reading the following detailed description with reference to the attached drawings which illustrate the following.

DETAILED DESCRIPTION

Figure 1:
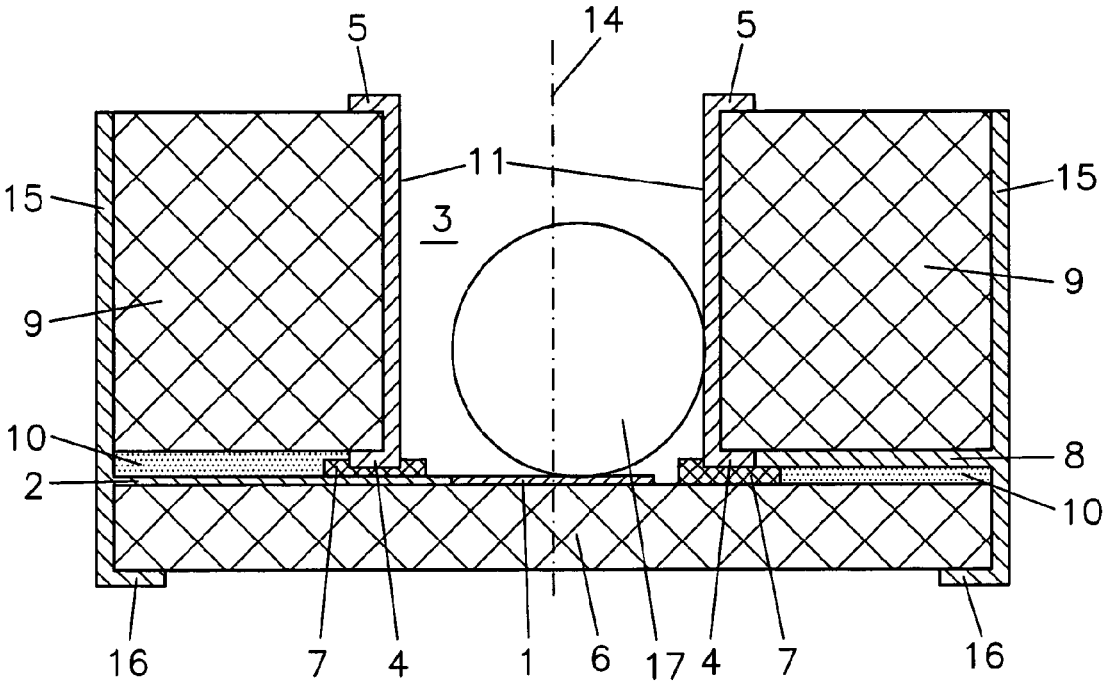
FIG. 1 illustrates the ball switch in an uncovered state.

A ball switch according to an embodiment in a multi ball-switch arrangement in a layer-/plate-type construction is composed of a first plate of plastic, the base plate, upon which a circular disk of electrically conductive material is centrally configured. An electrical contact track leads away from the circular disk and ends at the edge of the region of the ball switch on the side of the base plate facing opposite the circular disk. In conformance with the configuration of the circular disks on the first plate, a second plate of plastic, the chamber plate, located on the base plate, has a through-extending bore, the chamber having an electrically conductive, metallic inner wall, whose longitudinal chamber axis extends through the center of the assigned circular disk. On at least one chamber plate side, a contact track extends outwardly away from the metallic inner wall. This contact track ends on the contact tag side of the circular disk, facing opposite the same. Located in the chamber is an electrically conductive ball, whose diameter is smaller than that of the chamber and whose height dimensions, however, do not allow a second such ball to fit completely in the chamber.

According to an embodiment, the present invention provides the ball switch of a multi ball-switch arrangement in a way that will enable a multi ball-switch arrangement to be manufactured from at least two plastic boards, a bottom board and a chamber board, by employing a few process-engineering steps, whereby the ball switches are provided with a circular surface having a contact track extending away from the same and a chamber wall that is electrically insulated therefrom. A third board, the cover board, may cover the multi ball-switch arrangement, as needed.

The ball switches are structurally configured and aligned on the boards that are involved. The circular disk and the contact track extending away therefrom toward the exterior of the ball switch reside in one plane on one side of a plastic board, the bottom board, into which the conductor regions are introduced using photographic patterning techniques and wet chemical etching. Every ball switch is configured with its base plate thereon. The ball switches are arranged in a serial configuration.

The metallic inner wall of the chamber in the second plate, the chamber plate, ends as an annular strip on both sides of the chamber plate. The chambers are through-extending bores in the chamber board. If an assembled base board and chamber board are provided, a circular disk and a chamber are then disposed mutually concentrically and electrically insulated from one another.

Surrounding the circular disk on the base plate of the ball switch is a concentric ring of dielectric material, the sealing ring, upon which the opposite metallic annular strip on the chamber plate rests completely and concentrically.

The base plate and the chamber plate are joined/pressed together by an adhesive layer which surrounds the circular disk and extends up to the edge of the base plate. The chamber wall is thereby electrically insulated from the circular disk and the conductor track which extends away therefrom. A sealing function is provided by the sealing ring disposed between the annular strip of the chamber and the base plate. Thus, the chamber plate and the base plate form a socket within which the ball is held in constant contact with the circular disk and is able to move, provided that the socket moves only perpendicularly to the chamber axis.

If the ball switch were always disposed with certainty with its chamber axis perpendicularly to the force of gravity, with the socket opening only pointing upwards, and if it only moved perpendicularly to the chamber axis, there would be no need for a cover plate a cover board on the free side of the chamber plate (chamber board).

To ensure that the ball is reliably held in its socket, the chamber plate, chamber board, is covered with a third plate, the cover plate (e.g., cover board of plastic). When no electrical function, but rather only a closing function is required of the cover plate, it is conceivable that it does not have any structure. Thus, it may be flat or be merely constituted of a sealing ring that is concentrically disposed relative to the opposite annular strip of the chamber. However, if an electrical function is required, it may have the structural form of the base plate. Thus, it may be configured so as to be mirror-inverted relative to the base plate, for example. Another cover having no electrical function is possible in that the chamber is simply covered by a cover having at least the diameter of the chamber, with a sealing ring disposed therebetween. The ball is then hermetically sealed therein, and the ball switch, respectively the multi ball-switch arrangement constructed therefrom may be moved in any given manner, is also protected against contaminated atmosphere and, as a result, maintains a constant switching performance over the long term.

Diameter $D_{Kr}$ of the circular disk is within the following region. In the case of contact, it is intended that the circular disk reliably contact the ball in every instantaneous ball position:

$$D_{Ka}-D_{Ku}<D_{Kr}<D_{Ka},$$

$D_{Ka}$ being the chamber diameter and $D_{Ku}$ the ball diameter. Accordingly, for the mass production of the ball switch, ball diameter $D_{Ku}$ is greater than diameter differential $D_{Ka}-D_{Ku}$.

A semitubular, electrically conductive contact track, in which the contact track extending from the circular disk or the chamber inner chamber wall ends, extends continuously along each of two mutually opposing sides of the ball switch which are disposed in parallel to the longitudinal chamber axis and at which the contact track extending from the circular disk or the inner chamber wall ends. These are the through-extending bores in the boards which form the multi ball-switch arrangement.

Regardless of which atmosphere the exposed surfaces in the chamber and the ball surface are exposed to, the surfaces must be made of material that is inert to the chamber atmosphere, whether in electrically conductive regions or in electrically non-conductive regions. In this context, the enclosed ball may be made of any given material, provided that the ball surface meets the requirements of an electrically conductive surface that is inert to atmosphere. It may also be solidly made of electrically conductive material, in some instances having a heat-treated (hardened and tempered) surface. It holds for the circular disk having an outgoing conductor track on the ball switch bottom and possibly on the ball switch cover, that it is made of metallic material and that it at least fulfills this requirement of being inert to atmosphere at the conductor surface that is exposed in the chamber.

This ball switch design which includes the outgoing contact tracks which extend flat from the contact surfaces to the edge permits manufacturing using screen printing and electroplating, thereby eliminating the need, as exists under the related art, for vertical bias in the ball switch plates. From a standpoint of production engineering, this is a significant benefit and is thus economically advantageous.

FIG. 1 shows the ball switch in its simplest open form in a central cross section. Discernible on the top side of base plate 6 and produced using photographic patterning techniques and wet chemical etching are the central contact surface of circular disk 1 and contact track 2 which extends out flat therefrom to the left ball switch edge. Sealing ring 7 is disposed concentrically to circular disk 1 and thereby forms an annular gap in the contact tag-free region, to provide electrical isolation from electrically conductive chamber wall 11. Outside of sealing ring 7, base plate 6 is coated with an adhesive 10, and chamber plate 9 is placed thereon, respectively is pressed together with base plate 6; circular disk surface 1 on base plate 6 and chamber 3 are disposed concentrically, at least virtually concentrically in such a way that annular strip 4 rests thereon, extending continuously circumferentially. Sealing ring 7 has width dimensions such that, even in the case of a tolerable eccentricity of the circular disk relative to the chamber, metallic annular strip 4 of inner chamber wall that is drawn on the chamber plate side, rests uninterrupted on the same. From this annular strip 4, contact track 8 extends flat to the opposite edge of chamber plate 9, in a direction opposite that extending from circular disk 1 to contact track 2. The two contact tracks 2 and 8 each extend electroconductively to merge transitionally into traversing semitubular contact track 15, on the one hand, for the circular disk contact and, on the other hand, for the inner chamber wall contact. Both semitubular contact tracks 15 are bent over on the bottom side of the base plate and each end in a soldering pad 16 for the ball switch connection.

Figure 2:
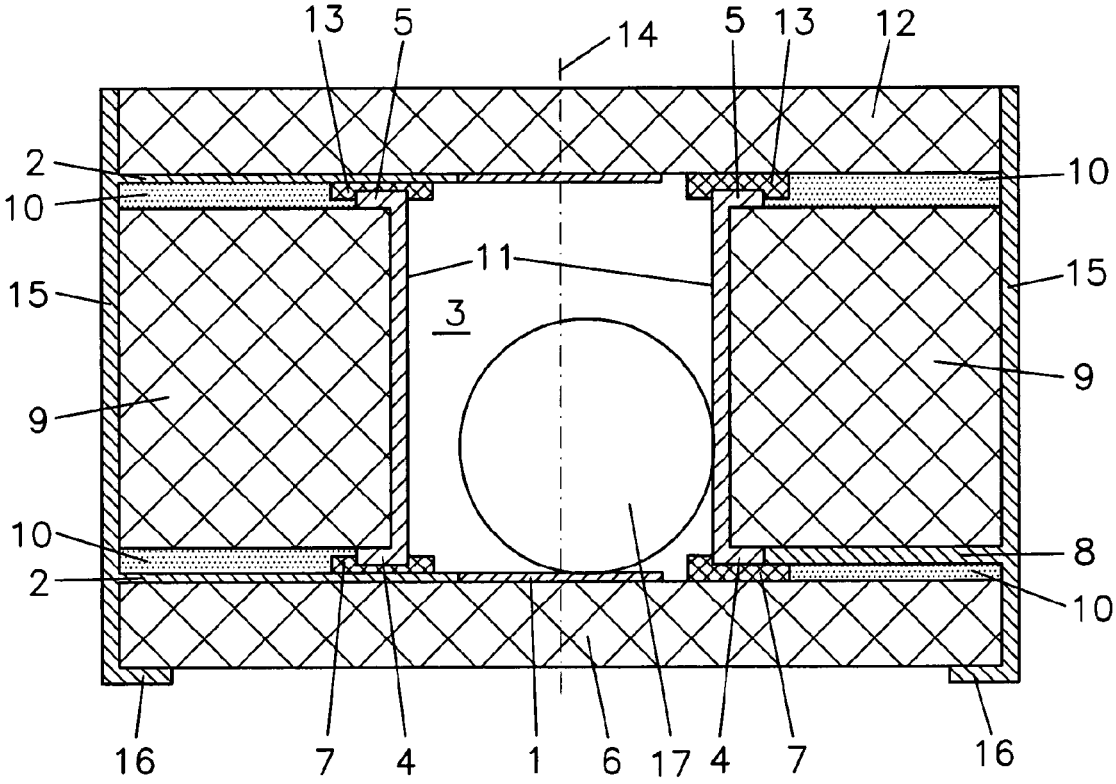
FIG. 2 illustrates a ball switch cover having an electrical function.

FIG. 2 shows the configuration of FIG. 1 expanded to include cover plate 12. This cover plate 12 hermetically encloses ball 17 in chamber 3 of the ball switch. For FIG. 2, an embodiment was selected in which cover plate 12 is mirror-inverted relative to base plate 6. Thus, besides providing hermetic covering, cover plate 12 also has an electrical function. For the complete switch function, at least contact track 2 must lead out from circular disk 1 at cover plate 12. The contact track that leads out from chamber wall 11 may be eliminated at the cover plate at the top; in the case of base plate 6, extended contact track 8 suffices. This sealed chamber design is symmetrical to the center line of the ball switch. In the illustrated case, at cover plate 12, contact track 2 contacts left semitubular contact track 15 which extends continuously along the ball switch. The ball switch is in the closed state when ball 17 bridges above or below. If left semitubular contact track 15 were separated in the middle, for example, a position or an acceleration direction of the ball switch could be indicated by ball 17 bridging above or below.

In this exemplary embodiment of the ball switch, the two plates, base plate and chamber plate, respectively boards, base board and chamber boards, are glass-fiber reinforced circuit board material. The contact surfaces are made of copper, for example, exposed surface regions also possibly being heat-treated so as to render them inert to atmosphere. Once the structures for the multi ball-switch arrangement have been applied to the two or three boards in question, they are assembled/pressed together to form the multi ball-switch arrangement, and the through-extending bores for semitubular contact tracks 15 of directly adjacent ball switches are then introduced, and the wall of the bores is subsequently electroplated, a connection to the particular soldering pads 16 being provided.

The size of the ball switch is essentially only limited from a standpoint of production engineering, i.e., besides photographic patterning and wet chemical etching, precision mechanical and mechanical production steps, such as boring, are used.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMERALS

1. circular disk
2. contact track
3. chamber
4. annular strip
5. annular strip
6. base plate
7. sealing ring
8. contact track
9. chamber plate
10. adhesive layer
11. chamber wall
12. cover plate
13. sealing ring
14. chamber axis
15. contact surface
16. soldering pad

The invention claimed is:

1. A ball switch in a multi ball-switch arrangement, the ball switch comprising:
- a base plate;
- a metallic circular disk centrally disposed on the base plate;
- a first electrically-conductive contact track co-planar with the circular disk and extending therefrom to a first edge of the base plate;
- a dielectric sealing ring concentrically surrounding the circular disk;
- a chamber plate having a through-bore, the chamber plate being disposed opposite the base plate so as to form a chamber which concentrically circumscribes the circular disk, the chamber having a metallic inner wall with a circumferential first metallic annular strip disposed at a first end thereof at a first side of the chamber plate and a second metallic annular strip disposed at a second end thereof at a second side of the chamber plate, the sealing ring being disposed between the first metallic annular strip and the base plate so as to seal the chamber;
- an adhesive layer disposed between the chamber plate and the base plate around the circular disk so as to electrically insulate the inner wall from the circular disk; and
- an electrically conductive ball disposed in the chamber and having a diameter configured to prevent a further similar conductive ball from fitting into the chamber.

2. The ball switch according to claim 1, further comprising a second electrically-conductive contact track extending from the inner wall of the chamber to an edge of the chamber plate opposite the first edge of the base plate.

3. The ball switch according to claim 1, wherein the multi ball-switch arrangement is formed using at least one of a plate-type construction and a layer-type construction.

4. The ball switch according to claim 1, wherein the base plate and the chamber plate include plastic.

5. The ball switch according to claim 1, wherein the sealing ring is elastic.

6. The ball switch according to claim 1, further comprising a circular cover member having an additional sealing ring disposed between the cover member and an additional metallic annular strip, that is disposed on a second end of the inner wall of the chamber opposite the first end, so as to seal the chamber.

7. The ball switch according to claim 1, further comprising a first semi-tubular, electrically conductive contact track extending, parallel to a longitudinal axis of the chamber, at a first side of the chamber at the first edge of the base plate and ending in a first soldering pad disposed on a bottom side of the base plate opposite the chamber plate for a first external ball switch connection, and further comprising a second semi-tubular electrically conductive contact track extending, parallel to the longitudinal axis of the chamber, at a second side of the chamber opposite the first side and ending in a second soldering pad disposed on the bottom side of the base plate for a second external ball switch connection.

8. The ball switch according to claim 1, wherein at least exposed surfaces of the chamber and a surface of the ball are heat-treated and include a material that is inert to an atmosphere of the chamber.

9. The ball switch according to claim 1, further comprising a plastic cover plate disposed on the chamber plate opposite the base plate so as to seal the conductive ball within the chamber.

10. The ball switch according to claim 9, wherein a side of the cover plate facing the chamber is flat.

11. The ball switch according to claim 9, further comprising an additional sealing ring which is concentrically arranged between the cover plate and the second metallic annular strip, the second metallic annular strip extending continuously circumferentially.

12. The ball switch according to claim 9, wherein the cover plate is configured so as to be mirror-inverted relative to the base plate.

* * * * *